US010443235B2

(12) United States Patent
Ting

(10) Patent No.: US 10,443,235 B2
(45) Date of Patent: Oct. 15, 2019

(54) ADVANCED CURTAIN WALL TOP-DOWN RENOVATION

(71) Applicant: Advanced Building Systems, Inc., Wilmington, DE (US)

(72) Inventor: Raymond M. L. Ting, Pittsburgh, PA (US)

(73) Assignee: Advanced Building Systems, Inc., Wilmington, DE (US)

( * ) Notice: Subject to any disclaimer, the term of this patent is extended or adjusted under 35 U.S.C. 154(b) by 0 days.

(21) Appl. No.: 16/240,846

(22) Filed: Jan. 7, 2019

(65) Prior Publication Data

US 2019/0211552 A1 Jul. 11, 2019

Related U.S. Application Data

(60) Provisional application No. 62/615,268, filed on Jan. 9, 2018.

(51) Int. Cl.

| | |
|---|---|
| ***E04B 2/96*** | (2006.01) |
| ***E06B 9/02*** | (2006.01) |
| *E06B 9/00* | (2006.01) |

(52) U.S. Cl.

CPC ..... *E04B 2/965* (2013.01); *E04B 2/96* (2013.01); *E06B 9/02* (2013.01); *E06B 2009/005* (2013.01)

(58) Field of Classification Search

CPC ..... E04B 2/965; E04B 2/88; E06B 2009/005; E06B 3/54

(Continued)

(56) References Cited

U.S. PATENT DOCUMENTS 3,053,353 A * 9/1962 Miller ..... E04B 2/962 52/220.2
3,251,168 A 5/1966 Waring et al.
(Continued)

FOREIGN PATENT DOCUMENTS

| | | | |
|---|---|---|---|
| CN | 201236597 | Y | 5/2009 |
| EP | 0476289 | A1 | 3/1992 |
| GB | 2397310 | A | 7/2004 |
| JP | 200616776 | A | 1/2006 |
| KR | 10201000120867 | | 11/2010 |
| TW | 1596261 | B1 | 8/2017 |

OTHER PUBLICATIONS

International Searching Authority, International Search Report and Written Opinion of the International Searching Authority for International Application No. PCT/US16/33045, dated Oct. 7, 2016.

(Continued)

*Primary Examiner* — Paola Agudelo
(74) *Attorney, Agent, or Firm* — The Webb Law Firm

(57) ABSTRACT

A curtain wall renovation system for an exterior of a building includes a plurality of new mullions attached to a top surface of a first floor slab of a first floor and extending downwardly external to the building and below an outer edge of the first floor slab, and a temporary weather shield system assembled in a second floor below the first floor and inset from an outer edge of a second floor slab. The temporary weather shield system includes a plurality of dry anchoring devices fastened to a top surface of the second floor slab, a plurality of temporary mullions supported on the top surface of the second floor slab and each including a bottom and a top, and a plurality of reusable panels, each reusable panel being secured to two laterally adjacent temporary mullions of the plurality of temporary mullions.

16 Claims, 7 Drawing Sheets

(58) Field of Classification Search
USPC ..... 52/235
See application file for complete search history.

(56) References Cited

U.S. PATENT DOCUMENTS

| | | | | |
|---|---|---|---|---|
| 3,321,880 | A | 5/1967 | Ferrell et al. | |
| 3,367,077 | A | 2/1968 | Johnston | |
| 3,791,094 | A * | 2/1974 | Shannon, Jr. | E04G 21/16 52/747.1 |
| 3,903,671 | A | 9/1975 | Cuin et al. | |
| 3,978,629 | A | 9/1976 | Echols, Sr. | |
| 4,055,923 | A | 11/1977 | Biebuyck | |
| 4,449,341 | A * | 5/1984 | Taglianetti | E04B 2/88 52/235 |
| 4,543,755 | A | 10/1985 | Crandell | |
| 4,555,890 | A * | 12/1985 | Gartner | E04B 1/35 52/745.11 |
| 4,672,784 | A | 6/1987 | Pohlar | |
| 4,685,263 | A | 8/1987 | Ting | |
| 4,765,107 | A | 8/1988 | Ting | |
| 4,840,004 | A | 6/1989 | Ting | |
| 4,873,805 | A | 10/1989 | Ting | |
| 4,977,717 | A | 12/1990 | Niwata | |
| 5,035,099 | A | 7/1991 | Lapish | |
| 5,158,392 | A | 10/1992 | Takeda | |
| 5,452,552 | A | 9/1995 | Ting | |
| 5,481,839 | A | 1/1996 | Lang et al. | |
| 5,596,851 | A | 1/1997 | Ting | |
| 5,598,671 | A | 2/1997 | Ting | |
| 5,687,524 | A | 11/1997 | Ting | |
| 6,158,182 | A | 12/2000 | Biebuyck | |
| 6,393,778 | B1 | 5/2002 | Ting | |
| 6,591,562 | B2 | 7/2003 | Ting | |
| 6,598,361 | B2 | 7/2003 | Ting | |
| 6,715,248 | B2 | 4/2004 | Biebuyck | |
| 6,745,527 | B1 | 6/2004 | Sherman | |
| 7,043,884 | B2 | 5/2006 | Moreno | |
| 7,134,247 | B2 | 11/2006 | Ting | |
| 7,162,842 | B2 | 1/2007 | Ribic | |
| 7,681,366 | B2 | 3/2010 | De Gobbi | |
| 8,001,738 | B2 | 8/2011 | Ting | |
| 8,011,146 | B2 | 9/2011 | Krause | |
| 8,033,066 | B2 | 10/2011 | Griffiths | |
| 8,127,507 | B1 | 3/2012 | Bilge | |
| 8,166,716 | B2 | 5/2012 | Macdonald et al. | |
| 8,191,325 | B2 | 6/2012 | Ting | |
| 8,240,099 | B2 | 8/2012 | Hummel, III | |
| 8,365,481 | B2 | 2/2013 | Scully et al. | |
| 8,402,714 | B2 * | 3/2013 | Labrecque | E04B 2/965 52/745.09 |
| 8,413,403 | B2 | 4/2013 | Walker, III et al. | |
| 8,613,173 | B2 | 12/2013 | Ander et al. | |
| 9,200,444 | B2 | 12/2015 | Ra | |
| 9,638,367 | B2 | 6/2017 | Ting | |
| 2002/0124514 | A1 | 9/2002 | Higgins | |
| 2003/0033765 | A1 | 2/2003 | Ting | |
| 2003/0150179 | A1 * | 8/2003 | Moreno | E04F 13/0808 52/235 |
| 2003/0221381 | A1 | 12/2003 | Ting | |
| 2004/0079038 | A1 | 4/2004 | Crooker, Jr. | |
| 2005/0284053 | A1 | 12/2005 | Grunewald et al. | |
| 2006/0016137 | A1 | 1/2006 | Ferro | |
| 2008/0053015 | A1 | 3/2008 | Matechuk | |
| 2008/0222981 | A1 | 9/2008 | De Gobbi | |
| 2008/0313982 | A1 * | 12/2008 | Termohlen | E04B 2/90 52/235 |
| 2009/0241444 | A1 | 10/2009 | Griffiths | |
| 2009/0241466 | A1 * | 10/2009 | Gussakovsky | E04B 2/88 52/786.1 |
| 2010/0011687 | A1 | 1/2010 | Arias | |
| 2010/0037549 | A1 * | 2/2010 | Lynch | E04F 13/0889 52/506.08 |
| 2010/0132293 | A1 | 6/2010 | Voegele, Jr. et al. | |
| 2010/0257812 | A1 | 10/2010 | Schultz et al. | |
| 2011/0030296 | A1 * | 2/2011 | Joret | E04B 2/88 52/235 |
| 2013/0014636 | A1 * | 1/2013 | Dehghanyar | E04H 9/06 89/36.02 |
| 2013/0186031 | A1 | 7/2013 | Ting | |
| 2014/0157699 | A1 | 6/2014 | Moeller et al. | |
| 2014/0331579 | A1 | 11/2014 | Evensen et al. | |
| 2015/0275512 | A1 * | 10/2015 | Bertoldini | E04D 13/17 52/236.6 |
| 2015/0284950 | A1 * | 10/2015 | Stramandinoli | E04B 2/90 52/235 |
| 2016/0040702 | A1 | 2/2016 | Broussard et al. | |
| 2017/0241133 | A1 | 8/2017 | Ting | |

OTHER PUBLICATIONS

Notification of Transmittal of the International Search Report and the Written Opinion of the International Searching Authority, or the Declaration, dated May 15, 2013, PCT Serial No. PCT/US2013/021893.

Curtain Wall Anchoring Top of Slab Condition, Halfen Anchoring Systems advertising, date unknown.

Wausaw Window and Wall System, Curtainwall Products, Performance and Practicality (A Wausaw AIA-CES Presentation, date unknown.

Yakin, Victor J., "Anchoring curtain walls", Glass Magazine, Jun. 1, 2008, pp. 1-3.

Yakin, Victor J., "Glass Your Online Industry Resource", Glass Magazine, Jun. 1, 2008, p. 1.

Halfen, "Halfen HCW Curtain Wall" Technical Product Information, 2014, pp. 1-36.

Harmon Innovative Facade Solutions, "SMU6000 Curtain Wall Anchorage Options", Brochure, 2014, pp. 1-2.

Harmon Innovative Facade Solutions, UCW8000 Curtain Wall System Brochure, 2013, pp. 1-2.

Jordahl, "Design of Anchor Channels", Brochure, Oct. 2010, pp. 1-67.

Jordahl, "Anchor Channel Application", Brochure, pp. 1-28, date unknown.

Jordahl, "Anchor Channels jTA-CE", Brochure, Nov. 2013, pp. 1-3, dale unknown.

Jordahl, "Anchor Channels Guide to ETA Compatible Design", Brochure, pp. 1-54, dale unknown.

Jordahl, "Channels and Accessories Making Light Work of the Heaviest Loads", Brochure, Feb. 2013, pp. 1-56.

Knickerbocker, Chuck, Anchored in Reality: Getting Anchors and Embeds Right (http://www.usglassmag.com/fleldnoles/7p=280), Aug. 11, 2012, pp. 1-3.

Yakin, Victor, "Dependable Connections the Anchoring Systems Used to Transmit the Loads . . . ", http://www.glasscanadam.com/business-inlelligence/dependable-connections-889, Jul. 31, 2007, pp. 1-3.

CFS Construction Fixing Systems, "Glass Facade Fixings", Brochure, pp. 1-20, date unknown.

Centre for Window and Cladding Technology, Chapter 8 Brackets and Fixings, "CWCT Curtain Wall Installation Handbook", Handbook, Nov. 2001, pp. 1-7.

Australian Engineered Fasteners and Anchors Council, "Technical Note: Selection of Cast-in Channel for Safety Critical Applications", AEFAC Technical Note TN03-21/07/140D3, pp. 1-3, Jul. 21, 2014.

International Searching Authority, Notification of Transmittal of the International Search Report and the Written Opinion of the International Searching Authority, or the Declaration, International Application No. PCT/US17/19100 (Apr. 3, 2017).

Office Action Issued for TW Application No. 107109675, dated Jan. 9, 2019.

* cited by examiner

ADVANCED CURTAIN WALL TOP-DOWN RENOVATION

CROSS-REFERENCE TO RELATED APPLICATIONS

The present application is related to and claims priority to U.S. Provisional Patent Application Ser. No. 62/615,268, filed on Jan. 9, 2018.

BACKGROUND

An exterior curtain wall system is an outer covering of a building in which the outer walls are structural walls capable of resisting wind loads and sustaining inter-floor story drifts due to seismic loads and inter-floor deflection due to live floor loads. Curtain walls also have an aesthetic function representing the signature of the architect. Further, curtain walls have an interior environmental function by keeping weather out and keeping building occupants safe and comfortable. Curtain wall commonly is made from lightweight materials that reduce construction costs while maintaining a high-dollar appearance. Curtain walls sometimes are renovated to address water leakage and/or structural problems, to improve thermal and/or sound insulation, and/or to enhance a building's aesthetic appeal.

In high-rise curtain wall renovation projects, especially for projects undertaken in densely populated metropolitan areas that have limited available space for construction traffic, it is often desirable to implement top-down panel assembly methods. In top-down assembly, the curtain wall is progressively renovated from the top of the building toward the bottom of the building, thus renovating and enclosing the first or "bottom" floor last. Top-down renovation methods allow immediate re-occupancy of a renovated floor, prevent water and/or construction debris from falling into renovated lower floors, and avoid construction traffic going through renovated lower floors to upper floors undergoing renovation.

In addition to the overall cost of the materials and labor to install the new curtain wall, however, several additional costs should be considered by the building owner prior to commencing a curtain wall renovation. For example, the building owner should consider rental losses due to weather exposed areas (floors) and prolonged waiting periods for re-occupancy of the renovated floors during the renovation period. The building owner should also consider the cost of providing temporary weather shielding in the weather exposed areas during renovation. In addition, the building owner should consider the high cost of reusing previous curtain wall anchoring systems on existing floor slabs, especially in cases where existing embeds are unsafe for re-use.

Besides additional costs associated with curtain wall renovations, building owners should also keep in mind various technical factors that must be accounted for in renovating an existing curtain wall. For instance, the building owner should consider the architectural inflexibility for grid line design changes by using the previous curtain wall anchoring systems on existing floor slabs. In addition, the building owner should consider safety factors between removing the old wall and erecting the new wall, while maintaining a clean interior aesthetical feature of the new wall.

It is desirable to have a top-down curtain wall renovation method that addresses the foregoing cost and technical factors.

SUMMARY OF THE DISCLOSURE

Disclosed are top-down curtain wall renovation systems and methods for an exterior of a building. In the disclosed systems and methods, curtain wall renovation occurs floor-by-floor, starting from the top floor of a building to subsequent lower floors until the renovation is complete. Old curtain wall panels and mullions are removed and replaced with new curtain wall panels and mullions. After old curtain wall panels and mullions are removed from a floor, a temporary weather shield system is installed to protect the floor while new curtain wall panels are installed on an above floor.

Some disclosed systems have a plurality of new mullions attached to a top surface of a first floor slab of a first floor and extending downwardly external to the first floor slab and below the first floor slab. A temporary weather shield system is assembled in a second floor below the first floor and inset from an outer edge of a second floor slab of the second floor. The temporary weather shield system includes a plurality of dry anchoring devices fastened to a top surface of the second floor slab, a plurality of temporary mullions supported on the top surface of the second floor, and a plurality of reusable panels, each reusable panel being secured to two laterally adjacent temporary mullions of the plurality of temporary mullions. The bottom of each temporary mullion is structurally interlocked to a corresponding one of the plurality of dry anchoring devices, and the top of each temporary mullion is structurally interlocked to a corresponding one of the plurality of new mullions.

The bottom of each temporary mullion may be structurally interlocked to a dry anchoring device using a bottom connection clip that engages both the temporary mullion and the dry anchoring device without using any fasteners. The top of each temporary mullion may be structurally interlocked to a new mullion using a top connection clip that engages both the temporary mullion and the new mullion without using any fasteners. Further, each temporary panel may be secured to two laterally adjacent temporary mullions without using any fasteners.

Once new curtain wall panels are installed on the first (upper) floor, the temporary mullions and reusable panels of the temporary weather shield system may be removed from the second (lower) floor and moved to a third floor below the second floor. Old curtain wall panels may be removed from the third floor, and new mullions secured to the dry anchoring devices that are fastened to the second floor slab. Dry anchoring devices may be fastened to a third floor slab of the third floor, and the temporary mullions of the temporary weather shield system may be installed in the third floor by securing the temporary mullions to the dry anchoring devices and new mullions in the same manner that the temporary mullions had been installed on the second floor. The reusable panels may then be secured between laterally adjacent temporary mullions to protect the third floor while new curtain wall panels are installed for the second floor.

Once new curtain wall panels are installed for the second floor, the process of disassembling the reusable panels and temporary mullions, removing old curtain wall panels and mullions from the below floor, installing new mullions, assembling a temporary weather shield system in the below floor, and installing new curtain wall panels may be repeated until the curtain wall renovation is complete.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

The present disclosure is related to curtain wall systems of buildings and, more particularly, to top-down curtain wall renovation methods that incorporate a temporary weather shield system that incorporates an improved mullion anchoring system.

Exterior curtain wall systems for buildings typically consist of three main components, namely, wall panels providing weather protection, mullions providing structural support to the wall panels, and mullion anchoring systems providing a structural connection between the mullions and a building structural element. Mullion anchoring systems carry the dead load weight of the wall panels and transfer the load to the building structure, typically at the building base or at intermediate floor slabs. Mullion anchoring systems also absorb positive and negative wind loads acting on the wall panels.

The temporary weather shield systems described herein provide cost-effective reusable weather shielding during curtain wall renovation, and may be especially effective for use in top-down renovation methods. The temporary weather shield systems described herein also provide an inexpensive wall anchoring system that can be easily anchored to the top surface of existing floor slabs.

Figure 1:
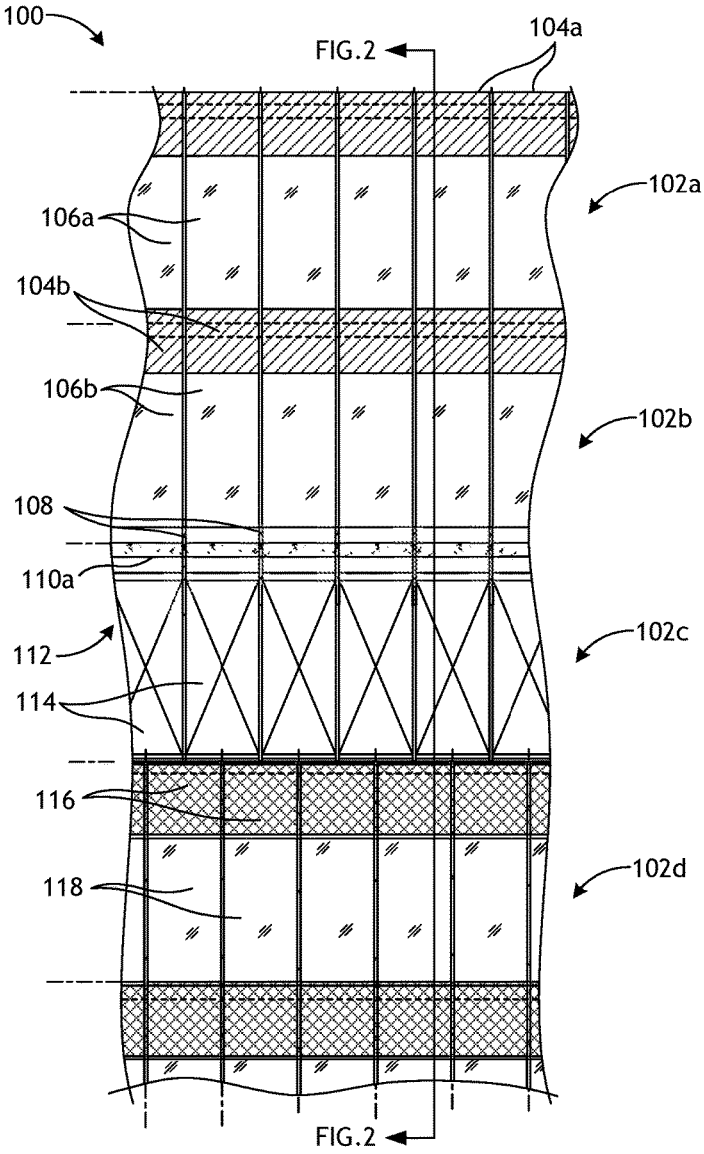
FIG. 1 is a partial front view of an example curtain wall in the process of renovation in accordance with the principles of the present disclosure.

FIG. 1 is a partial front view of an example curtain wall system 100 in the process of renovation in accordance with the principles of the present disclosure. The curtain wall system 100 may form part of any type of commercial or residential building such as, but not limited to, a high-rise building, an apartment building, a hotel/motel, a storefront, a retail or commercial building, an office building, an industrial or utility building, a bank, a hospital, or any combination thereof. As illustrated, the curtain wall system 100 includes a plurality of floors, shown as an $n^{th}$ floor 102*a*, an $n^{th}$-1 floor 102*b*, an $n^{th}$-2 floor 102*c*, and an $n^{th}$-3 floor 102*d*.

Figure 2:
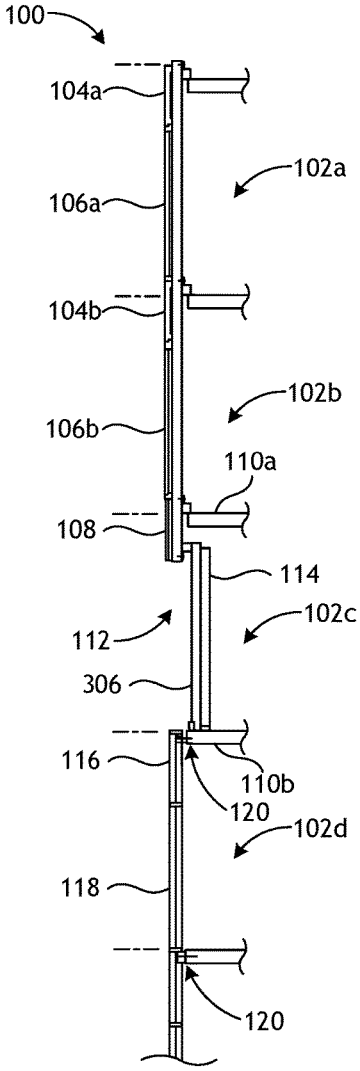
FIG. 2 is a cross-sectional side view taken along the indicated lines of FIG. 1.

The renovation depicted in FIGS. 1 and 2 comprises a top-down renovation method, where the curtain wall system 100 is progressively renovated from the top of the building toward the bottom of the building. Accordingly, as illustrated, the $n^{th}$ floor 102*a* has been completely renovated, the $n^{th}$-1 floor 102*b* is partially renovated, the $n^{th}$-2 floor 102*c* is in the process of being renovated, and the $n^{th}$-3 floor 102*d* is an old floor that will be renovated following completion of the $n^{th}$-2 floor 102*c*. The top-down panel system designs and erection methods discussed herein may be similar in some respects to those described in U.S. Pat. No. 8,191,325, the contents of which are hereby incorporated by reference.

In at least one embodiment, the renovation proceeds in the following manner. As shown in FIGS. 1 and 2, new mullions 108 for the $n^{th}$-1 floor 102*b* extend downwardly into the spandrel area past the floor slab 110*a*. New vision glass panels 106*b* for the $n^{th}$-1 floor 102*b* have been installed, and new spandrel panels for the spandrel area between the $n^{th}$-1 floor 102*b* and the $n^{th}$-2 floor 102*c* have not yet been installed. On the $n^{th}$-2 floor 102*c*, the old curtain wall panels and mullions have been removed, and a temporary weather shield system 112 has been installed.

Figure 6:
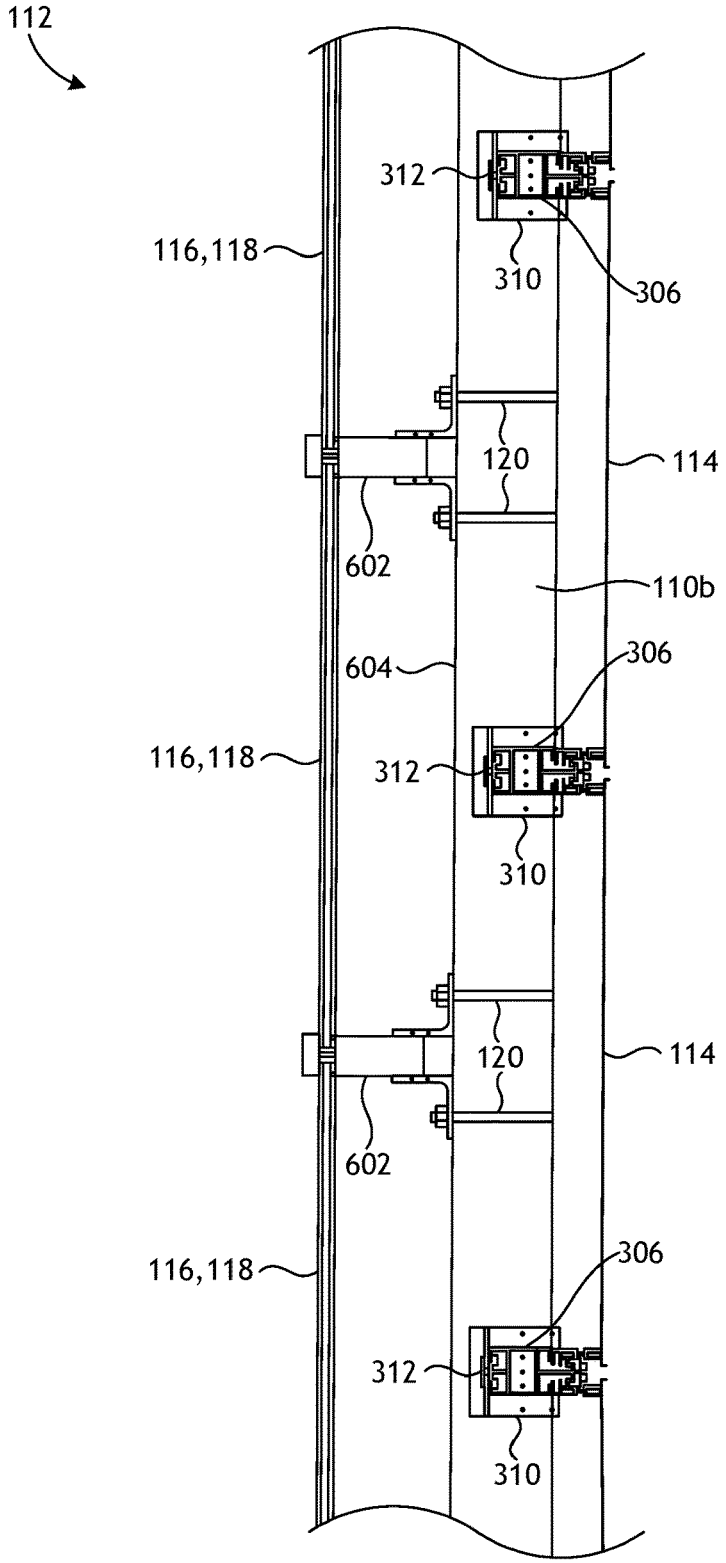
FIG. 6 is a partial cross-sectional top view of the temporary weather shield system of FIG. 3 as taken along the indicated lines in FIG. 3.

To continue the renovation, the temporary mullions 306 and reusable panels 114 of the temporary weather shield system 112 may be removed from the $n^{th}$-2 floor 102*c*. Then, old spandrel panels 116, old vision glass panels 118, and old mullions 602 (FIG. 6) are removed from the next floor below, the $n^{th}$-3 floor 102*d*. Dry anchoring devices are installed on the concrete floor slab of the $n^{th}$-3 floor 102*d*. If there are no interfering old anchoring devices, the dry anchoring devices may be installed prior to removal of the old spandrel panels 116, old vision glass panels 118, and old mullions 602 (FIG. 6).

New mullions spanning the $n^{th}$-2 floor 102*c* and extending downwardly into the spandrel area past floor slab 110*b* then may be spliced with the previously-installed new mullions 108 spanning the above floor 102*b*, and secured to the dry anchoring devices that are secured to the floor slab 110*b* of the $n^{th}$-2 floor 102*c*. The dry anchoring devices that are secured to the concrete floor slab 110*b* of the $n^{th}$-2 floor 102*c* may be the same dry anchoring devices that previously were secured to the temporary mullions 306 of the temporary weather shield system 112.

A temporary weather shield system may be installed on the $n^{th}$-3 floor 102*d*, and may reuse the temporary mullions and reusable panels that were removed from the $n^{th}$-2 floor 102*c*. The temporary weather shield system may be installed by securing the bottom end of each temporary mullion to a corresponding dry anchoring device that is secured to the floor slab of the $n^{th}$-3 floor 102*d*, and securing the top end of each temporary mullion to the bottom end of a corresponding new mullion spanning the $n^{th}$-2 floor 102*c* and extending downwardly into the spandrel area past floor slab 110*b*. The temporary mullions may be installed at the same time that the corresponding new mullions are being installed on the $n^{th}$-2 floor 102*c*. Next, reusable panels are installed between laterally adjacent temporary mullions to form the temporary weather shield system.

The temporary weather shield system protects the $n^{th}$-3 floor 102*d* while new spandrel panels for the spandrel area between the $n^{th}$-1 floor 102*b* and the $n^{th}$-2 floor 102*c* and new vision glass panels for the $n^{th}$-2 floor 102*c* are installed. Once those new panels have been installed, the top-down renovation process utilizing the disclosed dry anchoring devices and temporary weather shield system may be repeated for lower floors until the entire building curtain wall renovation is complete.

FIG. 2 is a cross-sectional side view taken along the indicated lines of FIG. 1. Reference to both FIGS. 1 and 2 is now made to describe the features of the curtain wall system 100. As illustrated, the $n^{th}$ floor 102*a* includes a row of new spandrel panels 104*a* at the top and a row of new vision glass panels 106*a* positioned below the new spandrel panels 104*a*. The $n^{th}$-1 floor 102*b* is located below the $n^{th}$ floor 102*a* and includes a second row of new spandrel panels 104*b* and a second row of new vision glass panels 106*b* positioned therebelow. A plurality of vertically oriented new mullions 108 extend past and below the second row of new vision glass panels 106*b* and further extend below an exposed edge of a floor slab 110*a* forming part of the $n^{th}$-1 floor 102*b*.

The $n^{th}$-2 floor 102*c* is located below the $n^{th}$-1 floor 102*b*. The previous curtain wall panels and mullions have been removed from the $n^{th}$-2 floor 102*c*, and a temporary weather shield system 112 is assembled in the $n^{th}$-2 floor 102*c* to provide temporary weather shielding. As illustrated, the temporary weather shield system 112 includes, among other component parts, one or more reusable panels 114 supported vertically on a second floor slab 110*b*, which forms part of the $n^{th}$-2 floor 102*c*.

The $n^{th}$-3 floor 102*d* is located below the $n^{th}$-2 floor 102*c* and includes a row of old spandrel panels 116 and a row of old vision glass panels 118 positioned therebelow. In the illustrated application, the old spandrel panels 116 and old vision glass panels 118 comprise separate component parts, but may alternatively be combined into single units common to conventional unitized systems. As illustrated, the old curtain wall is depicted as a typical stick curtain wall system, where the old spandrel panels 116 and old vision glass panels 118 (or a combination thereof) are vertically supported using conventional slab edge embeds 120 anchored to the edges (ends) of the corresponding floor slabs. As will be appreciated, however, this is shown for illustrative purpose only and, therefore, should not be considered limiting to the scope of the present disclosure. Rather, the renovation methods described herein are applicable to unitized curtain wall systems that use embeds with protruding anchoring bolts above the floor slab surface, without departing from the scope of the disclosure.

When the old curtain wall panels and mullions are removed from a particular floor, the top-down renovation of the curtain wall system 100 results in the creation of a large vertical gap extending between the upper, renovated portions of the curtain wall system 100 and the lower, dated (old) portions of the curtain wall system 100. The resulting vertical gap is best seen in FIG. 2 as currently created at the $n^{th}$-2 floor 102*c* and otherwise between the $n^{th}$-1 and $n^{th}$-3 floors 102*b*, 102*d*. The temporary weather shield system 112 may be installed and otherwise assembled in the vertical gap to provide temporary weather shielding against wind and rain.

As illustrated, the temporary weather shield system 112 is inwardly inset from the curtain wall system 100. More particularly, the reusable panels 114 may be supported by the underlying floor slab 110*b* at a location inward from the outer edge of the floor slab 110*b*. Positioning the reusable panels 114 structurally inward from edge of the floor slab 110*b* allows easy installation of the reusable panels. The near one floor height of the temporary mullions 306 helps prevent potential accidental damage to the erected new curtain wall during the process of removing the old wall.

Figure 3:
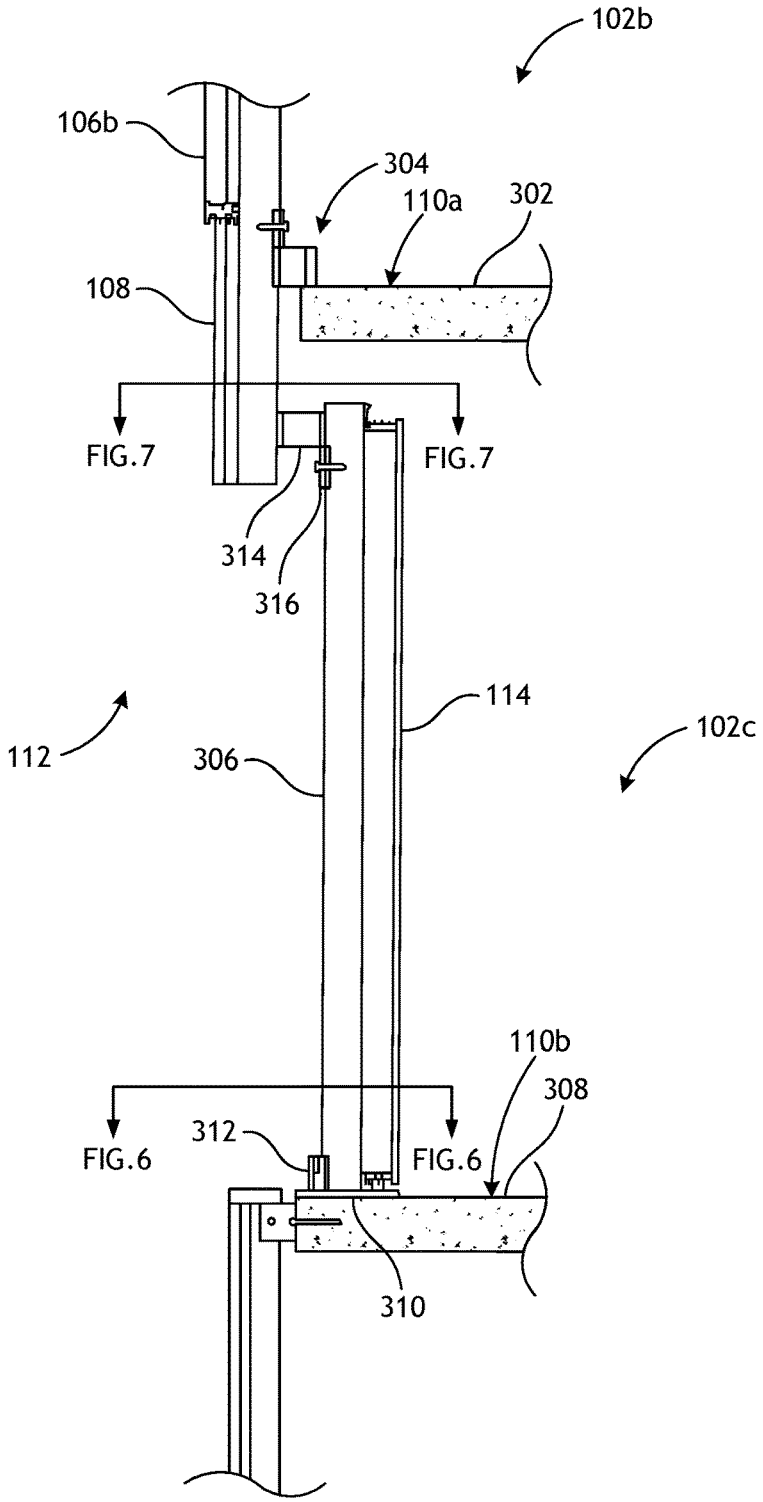
FIG. 3 is an enlarged cross-sectional side view of the temporary weather shield system of FIGS. 1-2, according to one or more embodiments of the disclosure.

FIG. 3 is an enlarged cross-sectional side view of the temporary weather shield system 112 of FIGS. 1-2, according to one or more embodiments of the disclosure. As illustrated, the second row of new vision glass panels 106*b* is the last erected row of panels on the $n^{th}$-1 floor 102*b* and the erected mullions 108 extend down into the area occupying the $n^{th}$-2 floor 102*c*. Each new mullion 108 may be anchored to a top surface 302 of the floor slab 110*a* of the $n^{th}$-1 floor 102*b* using a mullion anchoring system 304. In some embodiments, the mullion anchoring system 304 may comprise any of the mullion anchoring systems disclosed in co-pending U.S. patent application Ser. No. 15/823,063, filed on Nov. 11, 2017 and entitled "Advanced Curtain Wall Mullion Anchoring System," the contents of which are incorporated herein by reference in their entirety.

The temporary weather shield system 112 may include reusable panels 114, and each reusable panel 114 may be secured to and otherwise interlocked between two adjacent, backward-facing temporary mullions 306. The temporary mullions 306 may have the same configuration as new mullions 108, but is placed in a backward-facing orientation.

In at least one embodiment, the reusable panels 114 may be secured to the adjacent temporary mullions 306 without using any fasteners (e.g., screws, bolts, etc.). The reusable panels 114 are installed between temporary mullions 306 in the same manner that a permanent wall panel would be installed between permanent mullions on the exterior of a building, except the reusable panels 114 and temporary mullions 306 are in a backward-facing (inward facing) orientation. Because the reusable panels 114 are on top of the floor slab 110*b*, the weight of the reusable panels 114 is supported by the floor slab 110*b*, and fasteners are not required to secure the reusable panels 114 to the temporary mullions 306. Structural engagement between the frames of the reusable panels 114 and the temporary mullions 306 provides wind load resistance without using any fasteners.

The temporary mullions 306 may be supported on a top surface 308 of the floor slab of the floor currently under renovation. In the illustrated embodiment, for example, the temporary mullions 306 are supported on the top surface 308 of the second floor slab 110*b* of the $n^{th}$-2 floor 102*c*. The bottom or "lower" end of each temporary mullion 306 may be structurally interlocked to a corresponding dry anchoring device 310 using a bottom connection clip 312. The term "dry" anchoring device refers to a mullion anchoring device that is secured to a concrete floor slab after the concrete is cured, without the need to embed components in the concrete before it is cured. In at least one embodiment, the bottom connection clip 312 facilitates a structural interconnection between the bottom end of the temporary mullion 306 and a corresponding dry anchoring device 310 without using any fasteners.

The dry anchoring device 310 may not only be used to anchor the temporary mullions 306 to corresponding floor slabs, but may also comprise the main anchoring component of the mullion anchoring system 304. Accordingly, the dry anchoring device 310 may be secured to the top surface of the corresponding floor slab at a location suitable for anchoring a corresponding new mullion 108 onto the top surface. The dry anchoring device 310 then may be used to first anchor the temporary mullions 306 to the corresponding floor slab, and then to anchor the new mullions 108 to the corresponding floor slab.

The top or "upper" end of each temporary mullion 306 may be structurally interlocked with an adjacent new mullion 108 using a top connection clip 314. More specifically, and as described in more detail below, opposing ends of the top connection clip 314 may be slidably received within each of the temporary mullion 306 and the adjacent new mullion 108. In at least one embodiment, a slide block 316 may be coupled to the temporary mullion 306 to prevent the top connection clip 314 from sliding out of engagement (e.g., downwardly) with the new mullion 108. Accordingly, in at least one embodiment, the upper end of each temporary mullion 306 may be structurally interlocked with an adjacent new mullion 108 without using any fasteners (e.g., screws, bolts, etc.).

Once the floor under renovation is complete, the bottom or "lower" end of each new mullion 108 may be coupled to another new mullion (not shown) using a splice joint (not shown). The resulting splice joint connecting vertically adjacent new mullions may be located in the spandrel area of the resulting renovated curtain wall system 100 (FIGS. 1 and 2). Consequently, the splice joints may be hidden in the areas defined by the new spandrel panels 104*a*, 104*b* (FIGS. 1 and 2), thus resulting in a clean interior aesthetic feature of the new curtain wall system 100.

Figure 4:
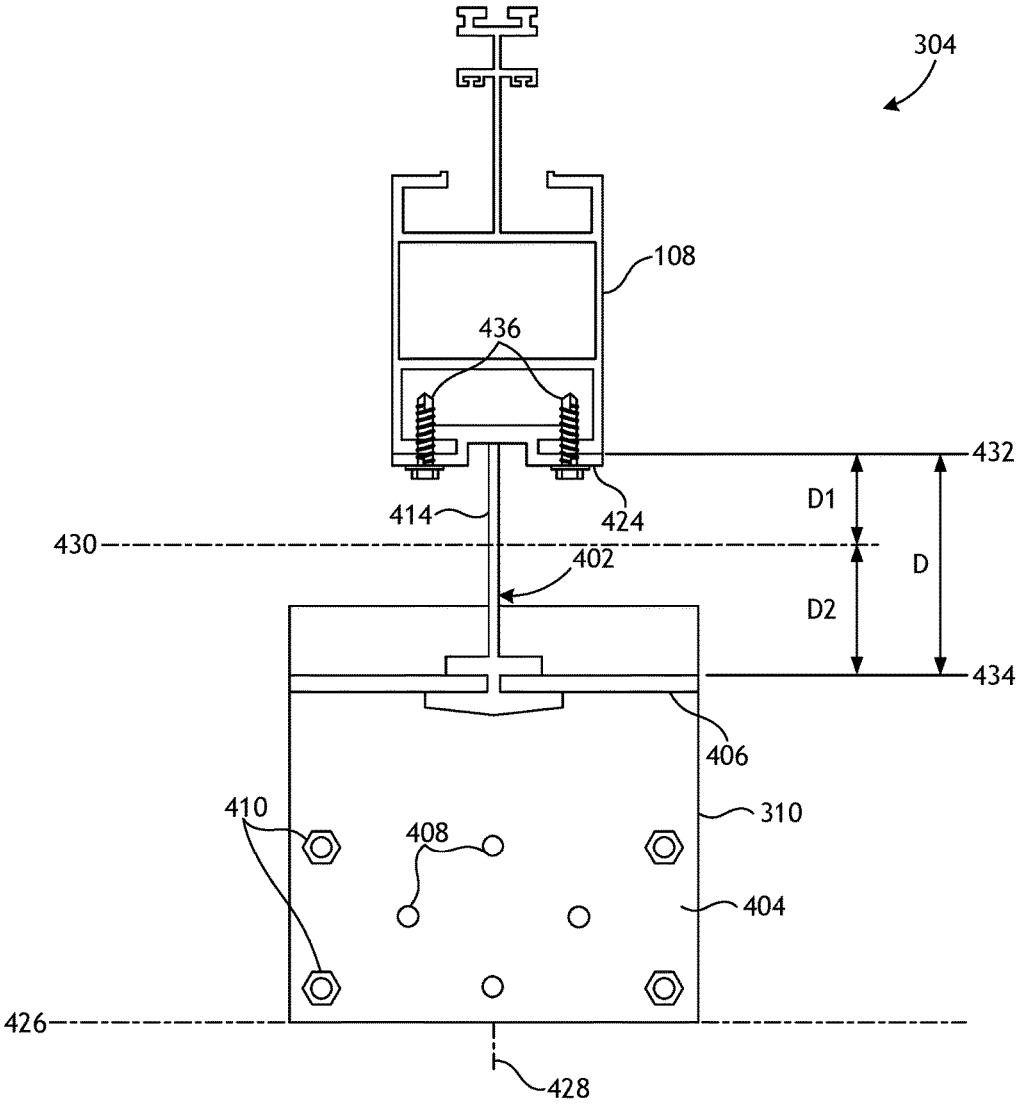
FIGS. 4 and 5 are top and exploded isometric views, respectively, of one example of the mullion anchoring system of FIG. 3, according to one or more embodiments.
Figure 5:
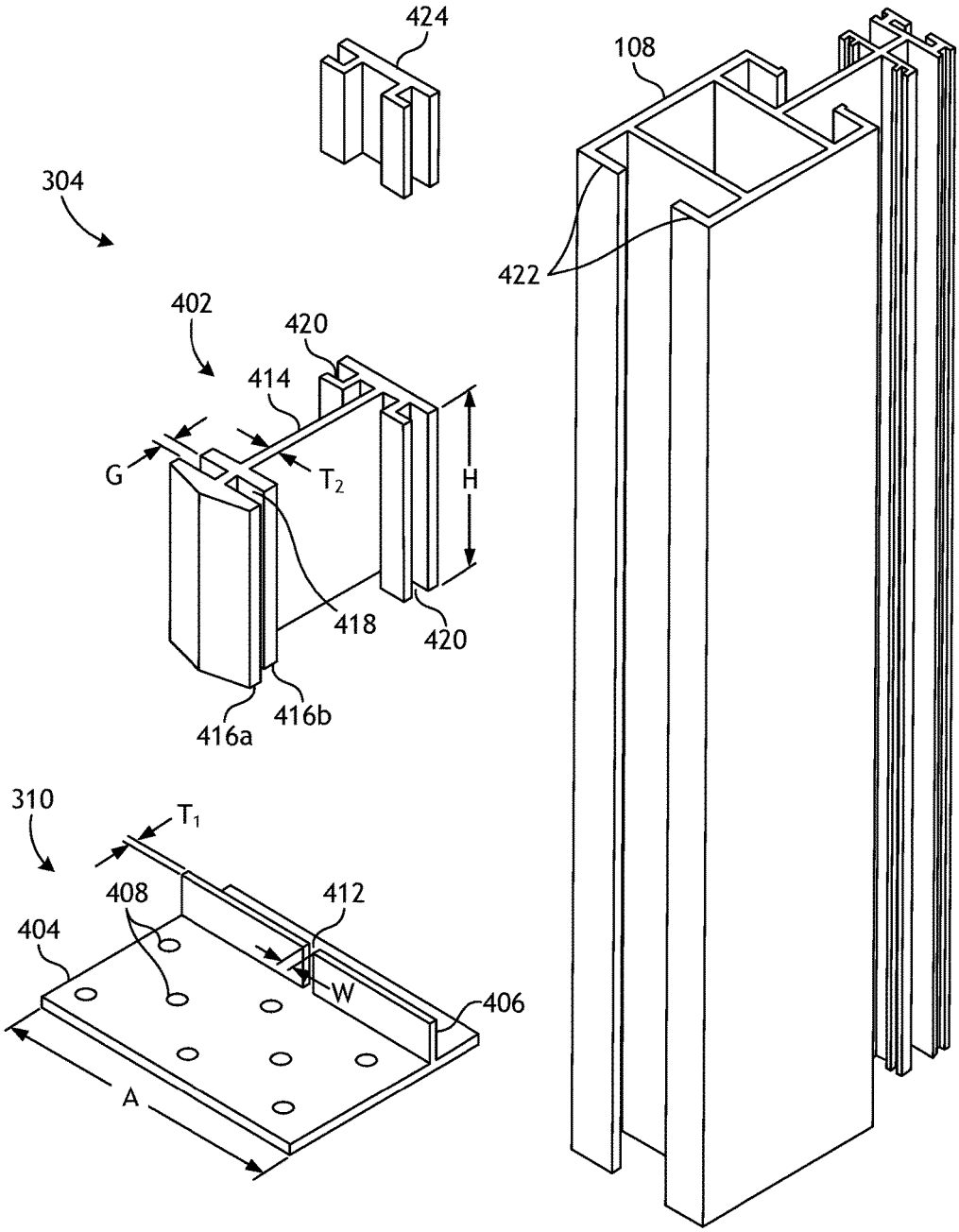

Referring now to FIGS. 4 and 5, illustrated are top and exploded isometric views, respectively, of one example of the mullion anchoring system 304 of FIG. 3, according to one or more embodiments. The mullion anchoring system 304 is but one example of a suitable anchoring system that may be used in accordance with the principles of the present disclosure. Other suitable anchoring systems include those described in co-pending U.S. patent application Ser. No. 15/823,063, previously incorporated by reference.

As illustrated, the mullion anchoring system 304 includes the dry anchoring device 310 and a mullion connector 402. The dry anchoring device 310 defines or otherwise provides a horizontal leg 404 and an upstanding load resisting lip 406. The dry anchoring device 310 may define one or more fastener holes 408 for receiving corresponding concrete anchors 410 (FIG. 4), which may comprise conventional concrete screws. The dry anchoring device 310 may be fastened to a cured floor slab (e.g., the floor slabs 110*a*, 110*b* of FIGS. 1-3) using the concrete anchors 410. The load resisting lip 406 may have a thickness $T_1$ (FIG. 5) and may provide or otherwise define a notch 412 (FIG. 5) having a width W (FIG. 5). The width W may be sized to receive a web 414 of the mullion connector 402, which may have a thickness $T_2$ (FIG. 5), and the thickness $T_2$ may be slightly less than the width W of the notch 412. In at least one embodiment, the notch 412 may be defined at the center of the load resisting lip 406, but could alternatively be located laterally offset from center, without departing from the scope of the disclosure.

The mullion connector 402 may be configured to slidably engage the new mullion 108 and be simultaneously received within the notch 412 of the dry anchoring device 310 to transfer reaction forces from the new mullion 108 to the building structure via the dry anchoring device 310. The web 414 of the mullion connector 402 may have a depth or length aligned in a direction perpendicular to the curtain wall (i.e., perpendicular to the face of the curtain wall panels) when installed.

The mullion connector 402 may have an integral negative wind load resisting leg 416*a* (FIG. 5) and an integral positive wind load resisting leg 416*b* (FIG. 5), each perpendicular to and extending from the proximal end (the end toward the building interior when installed) of the web 414. A gap 418 may be defined between the negative and positive wind load resisting legs 416*a*, 416*b* and may define a dimension G, which is slightly larger than the thickness $T_1$ of the load resisting lip 406. When the mullion connector 402 is engaged with the dry anchoring device 310, the left-and-right position is secured by engaging the web 414 of the mullion connector 402 in the notch 412 of the load resisting lip 406, and the in-and-out position is secured by engaging the load resisting lip 406 in the gap 418 of the mullion connector 402.

Under positive wind load conditions, the contact pressure between the inward-facing surface of the positive wind load resisting leg 416*b* and the outward-facing surface of the load resisting lip 406 resists positive wind load. Under negative wind load conditions, the contact pressure between the outward-facing surface of the negative wind load resisting leg 416*a* and the inward-facing surface of the load resisting lip 406 resists negative wind load. Alternative embodiments do not have a positive wind load resisting lip 416*b*. One of ordinary skill in the art would recognize alternative solutions for resisting positive wind load, such as by inserting a block between the load resisting lip and the back of the mullion.

Engagement of the web 414 of the mullion connector 402 in the notch 412 of the load resisting lip 406 facilitates engagement between the mullion connector 402 and the dry anchoring device 310 without a fastener. Alternatively, the load resisting lip 406 may not have a notch and the web 414 of the mullion connector may instead have a notch for engagement with the load resisting lip 406. In such embodiments, a fastener (not shown) may be used to secure the negative load resisting leg 416*a* to the load resisting lip 406 and thereby restrict lateral movement of the mullion connector 402.

At the distal end of the web 414 (e.g., the end toward the building exterior when installed), the mullion connector 402 may have a leg perpendicular to the web 414, with a female joint 420 (FIG. 5) at the end of each leg. The female joints 420 are configured for slidable engagement with corresponding male joints 422 (FIG. 5) on the new mullion 108. One of ordinary skill in the art would recognize various other joint configurations for engagement between the mullion connector 402 and the new mullion 108, such as having male joints on the mullion connector 402 and female joints on the new mullion 108, or other configurations described in U.S. Patent Application Publication No. 2013/0186031, which is incorporated by reference herein.

If the anchoring location is designed to resist dead load, then a dead load block 424 may be arranged on top of the mullion connector 402 and fastened to the new mullion 108. As illustrated, the dead load block 424 may have the same joint configuration as the mullion connector 402 for engagement with the male joints 422 of the new mullion 108. Accordingly, the dead load block 424 may be slidably received by the male joints 422 and move into a desired position vertically above the mullion connector 402.

Because the dry anchoring device may be installed after the concrete slab is cured, lateral (left-and-right) and in-and-out construction tolerance adjustments may be made by simply determining the proper lateral and in-and-out location and securing the dry anchoring device 310 to the floor slab at that location. The proper in-and-out location for the dry anchoring device 310 may be determined by reference to a fixed dimension specified in the building design. For example, the architect's drawing will specify a fixed distance between the curtain wall panel and certain building features, such as the spandrel column line. That fixed distance is the same, regardless of the actual position of the concrete floor slab edge. Based on that fixed distance and the fixed dimensions of the curtain wall panel, mullion, mullion connector, and anchoring device, the in-and-out position of the anchoring device relative to the spandrel column line can be calculated.

Thus, the desired in-and-out position of the dry anchoring device 310 relative to a building feature (e.g., a spandrel column line) may be determined based on a fixed dimension of the dry anchoring device 310 (e.g., distance between the back edge of the dry anchoring device 310 and the load resisting lip 406), a fixed dimension of the mullion connector 402 (e.g., the length of the mullion connector 402), and the fixed distance between the building feature and the new mullion 108 (e.g., the distance between the new mullion 108 and the spandrel column line).

Based on that calculated position, and with reference to FIG. 4, a reference line 426 parallel to the curtain wall surface may be marked on the floor slab indicating the position of the back edge of the dry anchoring device 310. All anchoring devices for mullions on the same side of a building may be aligned along this reference line 426. A mullion centerline position 428 for each mullion 108 is marked on the reference line 426 to indicate the left-and-right position of the dry anchoring device 310. The dry anchoring device 310 can then be secured to the floor slab at the proper position using the concrete anchors 410, without the need for further in-and-out or left-and-right construction tolerance adjustments during the process of erecting the mullions.

The line 430 in FIG. 4 represents the theoretical slab edge line shown on the architect's drawing. The line 432 in FIG. 4 lining up with the back surface of the new mullion 108 represents the maximum tolerable outward slab line with an outward construction tolerance of D1 as specified in the job specification. The line 434 in FIG. 4 lining up with the front face of the load resisting lip 406 of the dry anchoring device 310 represents the maximum tolerable inward slab line with an inward construction tolerance of D2 as specified in the job specification. Normally, the specified dimensions D1 and D2 are equal in magnitude with a positive sign for D1 and a negative sign for D2. The distance D signifies that actual slab edge locations are tolerable within the range of the distance D. The mullion connector 402 may be designed for a distance of "D" between lines 432 and 434 when the mullion connector 402 has been engaged with both the new mullion 108 and the dry anchoring device 310. The actual slab edge location is not perfectly straight and may wander within the space of "D" (i.e., between lines 432 and 434).

It is a common practice in the industry to specify ±1" (or ±25 mm) in-and-out construction tolerance for buildings up to fifteen stories high and ±2" (or ±50 mm) for buildings higher than fifteen stories high. Since the depth of the mullion connector 402 is designed for a specific "D" dimension, one mullion connector 402 can be designed for buildings up to fifteen stories high with "D" being equal to 2" (or 50 mm), and another mullion connector 402 can be designed for buildings higher than fifteen stories high with "D" being equal to 4" (or 100 mm). However, a mullion connector 402 designed for a specific "D" dimension can be used for any condition with a lesser "D" dimension by placing the reference line 426 father away from the theoretical slab edge line 430 in the inward direction. Therefore, a mullion connector 402 designed for a high-rise building can be used for all buildings.

The dry anchoring device 310 may comprise an extruded member. The fabrication of the extrusion for the dry anchoring device 310 may involve 1) cutting to length (dimension "A" in FIG. 5) as the width of the dry anchoring device 310; 2) providing the notch 412 on the load resisting lip 406 with a notch width of W; and 3) providing fastener holes 408 for the concrete anchors 410. The mullion connector 402 may also comprise an extruded member. The fabrication of the extrusion for the mullion connector 402 may entail simply cutting to length to provide the desired connector height H (FIG. 5).

FIG. 6 is a partial cross-sectional top view of the temporary weather shield system 112 as taken along the indicated lines in FIG. 3, according to one or more embodiments. The old spandrel panels 116 and/or the old vision glass panels 118 (or a combination thereof) may be secured to and otherwise supported on laterally adjacent old (dated) mullions 602. As mentioned above, the old mullions 602 may be anchored to the edge 604 of the second floor slab 110*b* using conventional slab edge embeds 120.

The bottom end of each temporary mullion 306 may be structurally interlocked to a corresponding dry anchoring device 310 secured to the underlying floor slab (e.g., the second floor slab 110*b*) without using any fasteners (e.g., screws, bolts, etc.). This may be accomplished by using a bottom connection clip 312 that connects a temporary mullion 306 to a dry anchoring device 310. In at least one embodiment, the bottom connection clip 312 has a web and two perpendicular legs, with a similar configuration as the proximal end of the mullion connector 402 (FIGS. 4-5). The web is configured to fit in the notch 412 (FIG. 5) of the dry anchoring device 310, with the load resisting lip 406 (FIGS. 4-5) secured between the gap between the two perpendicular legs of the bottom connection clip 312, similar to how the mullion connector 402 (FIGS. 4-5) engages with the dry anchoring device 310.

The bottom connection clip 312 is further configured to slidably engage the temporary mullion 306. In at least one embodiment, the bottom connection clip 312 has female joints corresponding to male joints of the temporary mullion 306, similar to the female joints 420 of the mullion connector and male joints of the new mullion 108 (FIG. 5).

To secure a temporary mullion 306 to a dry anchoring device 310, a bottom connection clip 312 first is placed on the dry anchoring device 310 and engaged with the load resisting lip 406 of the dry anchoring device 310, as described above. Next, the temporary mullion 306 may be lifted above the corresponding connection clip 312 and advanced downwardly to slidably receive a portion of the bottom connection clip 312. In some embodiments, for example, the bottom of the temporary mullion and the bottom connection clip 312 may be mateable via a male-female sliding relationship.

Since the dry anchoring devices 310 are installed and used to temporarily secure the temporary mullions 306 and subsequently secure the new mullions 108 (FIGS. 1-3) permanently, the resulting structural (vertical) lines for both the new and temporary mullions 108, 306 may vertically align (i.e., automatically match) without additional erection effort. In some applications, the structural (vertical) lines of the old mullions 602 may be laterally offset from the structural (vertical) lines of the temporary mullions 306 and the structural (vertical) lines of the new mullions 108. This may prove advantageous in providing a builder with freedom to alter the architectural grid line design of the curtain wall system 100 (FIG. 1), if desired. If the old mullions are anchored using an on-slab embed system (not shown), and maintaining the structural (vertical) lines of the old mullions is desired for the renovated curtain wall system, the protruding anchor bolts of the old on-slab embeds may need to be cut off to facilitate the installation of the dry anchoring device for the new mullions.

Figure 7:
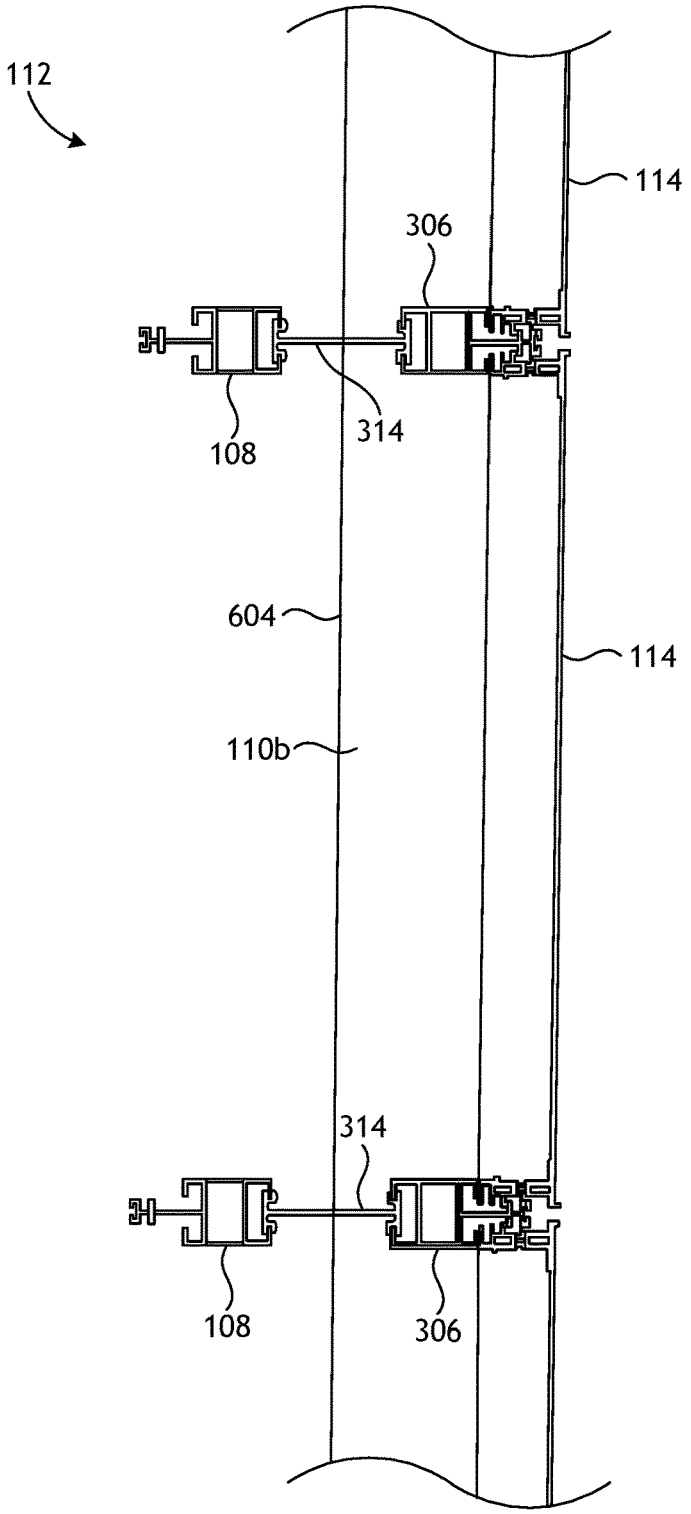
FIG. 7 is another partial cross-sectional top view of the temporary weather shield system of FIG. 3 as taken along the indicated lines in FIG. 3.

FIG. 7 is a partial cross-sectional top view of the temporary weather shield system 112 as taken along the indicated lines in FIG. 3, according to one or more embodiments. As illustrated, the new mullions 108 may be positioned on the exterior of the building and otherwise external (outset) to the edge 604 of the second floor slab 110*b*, while the temporary mullions 306 may be positioned on the interior of the building and otherwise internal (inset) to the edge 604. After securing the bottom end of each temporary mullion 306, as explained above with reference to FIG. 6, the upper end of each temporary mullion 306 may be secured to a corresponding new mullion 108 without the need for any fasteners (e.g., screws, bolts, etc.).

To accomplish this, the top connection clip 314 connects the bottom end of the new mullion 108 with the top end of the temporary mullion 306. The top connection clip 314 may be engaged with both the new mullion 108 and the temporary mullion 306 via a sliding mated engagement. In the illustrated embodiment, for example, the new mullion 108 and the temporary mullion 306 have the same configuration, with the temporary mullion 306 placed in a backward-facing orientation. The top connection clip 314 has a web with female joints on both ends of the web, similar to the female joints 420 of the mullion connector 402 (FIG. 5). The female joints of the top connection clip 314 slidably engage with corresponding male joints of both the new mullion 108 and the temporary mullion 306, in the same manner that the mullion connector 402 engages with the new mullion 108 (FIGS. 4-5).

To connect the new mullion 108 to the temporary mullion 306 using the top connection clip 314, the top connection clip 314 may be slidably engaged with the new mullion 108 and moved upwardly (e.g., by sliding) relative to the new mullion 108 to a position above the expected location of the upper end of the corresponding temporary mullion 306. After the bottom end of the temporary mullion 306 is engaged with the dry anchoring device 310 (FIG. 6), as described above, the top connection clip 314 may be allowed to descend downwardly to slidably engage with the temporary mullion 306, such that the joints on one end of the web of the top connection clip 314 are engaged with the bottom end of the new mullion 108, and the joints on the other end of the web of the top connection clip 314 are engaged with the top end of the temporary mullion 306. Similar to the engagement between the top connection clip 314 and the new mullion 108, the top connection clip 314 and the temporary mullion 306 may provide a mateable male-female sliding engagement.

In some embodiments, the slide block 316 (FIG. 3) is fastened to the temporary mullion 306 to prevent the top connection clip 314 from sliding too far downwardly and out of engagement with the new mullion 108. In such embodiments, the top connection clip 314 may be allowed to drop relative to the new mullion 108 until engaging or otherwise being seated on the slide block 316. Without the slide block 316, the top connection clip 314 may be able to descend past the bottom of the new mullion 108 and out of engagement therewith.

After two laterally adjacent temporary mullions 306 are secured at the top and bottom, as described herein, a reusable panel 114 may be installed to the laterally adjacent temporary mullions 306, as generally described above. Securing the temporary mullion 306 to the dry anchoring device 310 and the new mullion 108 in the manner described above resists wind load forces on the temporary weather shield system 112, in a similar manner to how securing a curtain wall to the dry anchoring device resists wind load forces, as described in U.S. Pat. No. 9,683,367.

Figure 8:
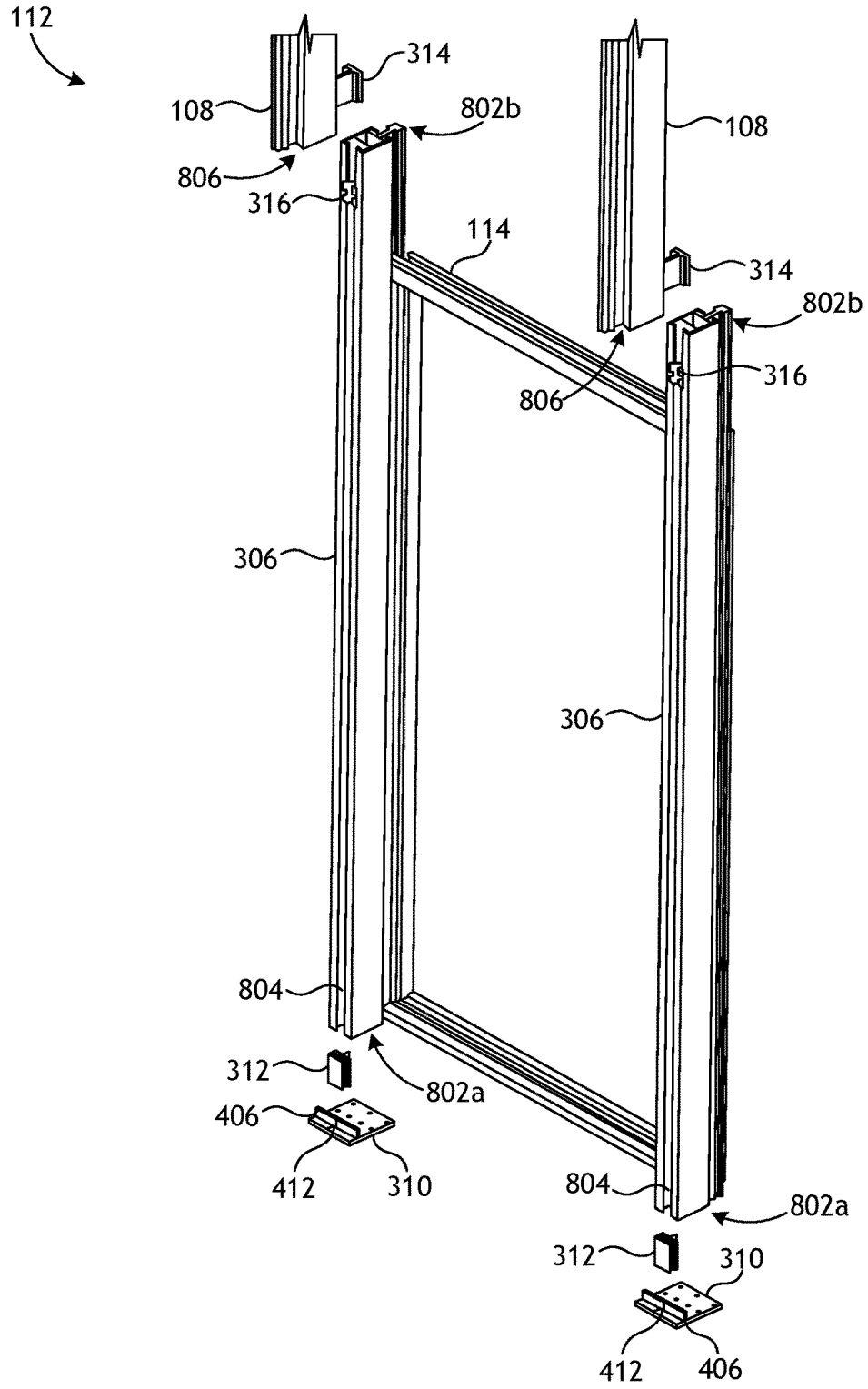
FIG. 8 is an isometric exploded view of the temporary weather shield system of FIG. 3, according to one or more embodiments.

Example assembly of the temporary weather shield system 112 of FIG. 3 is now provided with reference to FIG. 8 and with continued reference to FIGS. 6 and 7. As illustrated, FIG. 8 is an isometric exploded view of the temporary weather shield system 112 of FIG. 3. The temporary weather shield system 112 may be assembled by first anchoring the dry anchoring devices 310 to the upper surface of an underlying floor slab (e.g., floor slabs 110*a*, 110*b* of FIGS. 1-3). The appropriate position for the dry anchoring devices 310 may be determined or otherwise calculated as described above with reference to FIG. 4 and the lines 426-434. In general, the dry anchoring devices 310 may be positioned behind (e.g., inset into the building) the old wall at a location where the interconnected new mullions (not shown) are able to align with and be spliced into the erected mullions 108 above.

The bottom connection clips 312 may be removably coupled to corresponding dry anchoring devices 310. More specifically, the bottom connection clips 312 may be slid into engagement with the corresponding dry anchoring devices 310 by being received into the notch 412 defined by the load resisting lip 406 of the dry anchoring device 310. A corresponding temporary mullion 306 may then be lifted above the top of the bottom connection clip 312 and advanced downwardly (e.g., dropped) such that a bottom 802*a* of the temporary mullion 306 comes into sliding engagement with the bottom connection clip 312. In at least one embodiment, a portion of the bottom connection clip 312 may be slidably received within a slot 804 defined in the temporary mullion 306. In other embodiments, however, the bottom connection clip 312 may define a slot or the like that slidably receives the bottom 802*a* of the temporary mullion 306.

A top 802*b* of each temporary mullion 306 may then be secured to a corresponding previously erected new mullion 108. More specifically, the top connection clip 314 may be received by a corresponding new mullion 108 via sliding engagement. In some embodiments, for example, the top connection clip 314 may be slidably received into the corresponding new mullion 108 at a lower end 806 thereof. The top connection clip 314 may then be moved (slid) upward relative to the new mullion 108 until the top connection clip 314 is positioned vertically above the top 802*b* of the corresponding temporary mullion 306. The corresponding temporary mullion 306 may then be aligned laterally with (i.e., in the same right-to-left position), but inwardly offset from, the new mullion 108, and the top connection clip 314 may be moved downwardly relative to the new mullion 108 to slidably engage the temporary mullion 306. In at least one embodiment, a portion of the top connection clip 314 may be received within the slot 804 defined in the temporary mullion 306. Alternatively, the top 802*b* of the temporary mullion 306 may be received within a corresponding aperture or slot defined by the top connection clip 314, without departing from the scope of the disclosure.

In some embodiments, the top connection clip 314 may be dropped vertically relative to the new mullion 108 until engaging the slide block 316, which may also be received within the slot 804 and fastened to the temporary mullion 306. As indicated above, the slide block 316 may prevent the top connection clip 314 from sliding downward and out of engagement with the lower end 806 of the new mullion 108. Once two laterally adjacent temporary mullions 306 are secured at the respective bottoms and tops 802*a*, 802*b*, as described above, a reusable panel 114 may be secured to the laterally adjacent temporary mullions 306, as generally described above.

To remove the temporary weather shield system 112, one need only reverse the execution order of the foregoing steps, except for the installation of the dry anchoring devices 310, which will be used to permanently attach the new mullions 108 of the renovated floors. Upon removal, all components of the temporary weather shield system 112 (except for the dry anchoring devices 310) may be delivered to the next (lower) floor for reuse. Notably, besides anchoring the dry anchoring devices 310, assembling the temporary weather shield system 112 does not require any fastener and, therefore, its erection and removal can be executed efficiently. Moreover, significant cost savings can be realized since the installed temporary weather shield system 112 occupies very little interior floor space.

Therefore, the disclosed systems and methods are well-adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

What is claimed is:

1. A curtain wall renovation system for an exterior of a building, comprising:

a plurality of new mullions attached to a top surface of a first floor slab of a first floor and extending downwardly external to the first floor slab and below the first floor slab; and a temporary weather shield system assembled in a second floor below the first floor and inset from an outer edge of a second floor slab of the second floor, the temporary weather shield system including:

a plurality of dry anchoring devices fastened to a top surface of the second floor slab;

a plurality of temporary mullions supported on the top surface of the second floor slab and each including a bottom and a top; and a plurality of reusable panels, each reusable panel being secured to two laterally adjacent temporary mullions of the plurality of temporary mullions, wherein the bottom of each temporary mullion is structurally interlocked to a corresponding one of the plurality of dry anchoring devices, and wherein the top of each temporary mullion is structurally interlocked to a corresponding one of the plurality of new mullions.

2. The curtain wall renovation system of claim 1, wherein said plurality of reusable panels are secured to said plurality of temporary mullions without fasteners, wherein said plurality of temporary mullions is structurally interlocked to said plurality of dry anchoring devices without fasteners, and wherein said plurality of temporary mullions is structurally interlocked to said plurality of new mullions without fasteners.

3. The curtain wall renovation system of claim 1, further comprising a bottom connection clip that structurally interlocks the bottom of each temporary mullion to the corresponding one of the plurality of dry anchoring devices, wherein the bottom connection clip engages the bottom of each temporary mullion and the corresponding one of the plurality of dry anchoring devices.

4. The curtain wall renovation system of claim 3, wherein the bottom connection clip slidably engages one or both of the bottom of each temporary mullion and the corresponding one of the plurality of dry anchoring devices via a mateable male-female sliding engagement.

5. The curtain wall renovation system of claim 1, further comprising a top connection clip extending between and structurally interlocking the top of each temporary mullion to the corresponding one of the plurality of new mullions, wherein opposing ends of the top connection clip engage the top of each temporary mullion and the corresponding one of the plurality of new mullions.

6. The curtain wall renovation system of claim 5, wherein the top connection clip slidably engages one or both of the top of each temporary mullion and the corresponding one of the plurality of new mullions via a mateable male-female sliding engagement.

7. The curtain wall renovation system of claim 5, further comprising a slide block coupled to one of the plurality of temporary mullions and engageable with the top connection clip to prevent the top connection clip from sliding out of engagement with the corresponding one of the plurality of new mullions.

8. The curtain wall renovation system of claim 1, wherein a structural line for the plurality of new mullions vertically aligns with a structural line for the plurality of temporary mullions.

9. The curtain wall renovation system of claim 8, further comprising a plurality of old mullions extending below the second floor, wherein the structural line for the plurality of new mullions is not aligned with a structural line of the plurality of old mullions.

10. A method of renovating a curtain wall system for an exterior of a building, comprising:

attaching a plurality of new mullions to a top surface of a first floor slab of a first floor, the plurality of new mullions extending downwardly external to the building and below an outer edge of the first floor slab;

assembling a temporary weather shield system in a second floor below the first floor and inset from an outer edge of a second floor slab of the second floor, wherein assembling the temporary weather shield system includes:

fastening a plurality of dry anchoring devices to a top surface of the second floor slab;

supporting a plurality of temporary mullions on the top surface of the second floor slab, each temporary mullion including a bottom and a top; and securing reusable panels between laterally adjacent temporary mullions of the plurality of temporary mullions;

structurally interlocking the bottom of each temporary mullion to a corresponding one of the plurality of dry anchoring devices; and structurally interlocking the top of each temporary mullion to a corresponding one of the plurality of new mullions.

11. The method of claim 10, wherein attaching the plurality of new mullions to the top surface of the first floor slab of the first floor comprises:

attaching each new mullion to the top surface of the first floor slab using a mullion anchoring system, each mullion anchoring system including:

a dry anchoring device left fastened to the top surface of the first floor slab following renovation of the first floor; and a mullion connector extending between and structurally interlocking the dry anchoring device without a fastener to one of the plurality of new mullions.

12. The method of claim 10, wherein structurally interlocking the bottom of each temporary mullion to the corresponding one of the plurality of dry anchoring devices comprises:

engaging a bottom connection clip with each dry anchoring device;

lifting each temporary mullion above the bottom connection clip; and dropping each temporary mullion into sliding engagement with the bottom connection clip.

13. The method of claim 10, wherein structurally interlocking the top of each temporary mullion to the corresponding one of the plurality of new mullions comprises:

slidably engaging a top connection clip against each new mullion;

sliding the top connection clip upward relative to each new mullion until the top connection clip is positioned vertically above the top of each temporary mullion;

aligning each temporary mullion with the corresponding one of the plurality of new mullions; and sliding the top connection clip downward relative to the corresponding one of the plurality of new mullions and into sliding engagement with each temporary mullion.

14. The method of claim 13, further comprising preventing the top connection clip from sliding out of engagement with the corresponding one of the plurality of new mullions with a slide block coupled to each temporary mullion.

15. The method of claim 10, wherein the plurality of new mullions comprises a first plurality of new mullions, and the plurality of dry anchoring devices comprises a first plurality of dry anchoring devices, the method further comprising:

disassembling the temporary weather shield system from the second floor except for the first plurality of dry anchoring devices fastened to the top surface of the second floor slab;

attaching a second plurality of new mullions to the top surface of the second floor slab, the second plurality of new mullions extending downwardly external to the building and below the outer edge of the second floor slab;

assembling the temporary weather shield system in a third floor below the second floor and inset from an outer edge of a third floor slab of the third floor, wherein assembling the temporary weather shield system in the third floor includes:

fastening a second plurality of dry anchoring devices to a top surface of the third floor slab;

supporting the plurality of temporary mullions on the top surface of the third floor slab; and securing the reusable panels to two laterally adjacent temporary mullions of the plurality of temporary mullions;

structurally interlocking the bottom of each temporary mullion to a corresponding one of the second plurality of dry anchoring devices; and structurally interlocking the top of each temporary mullion without a fastener to a corresponding one of the second plurality of new mullions.

16. The method of claim 15, wherein attaching the second plurality of new mullions to the top surface of the second floor slab comprises structurally interlocking each new mullion of the second plurality of new mullions to a corresponding one of the first plurality of dry anchoring devices with a mullion connector.

* * * * *